US007418839B2

(12) United States Patent
Kwon et al.

(10) Patent No.: US 7,418,839 B2
(45) Date of Patent: Sep. 2, 2008

(54) CONTROL PANEL ASSEMBLY FOR WASHING MACHINE

(75) Inventors: Ik Kun Kwon, Changwon-si (KR); Sun Woo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 609 days.

(21) Appl. No.: 11/034,826

(22) Filed: Jan. 14, 2005

(65) Prior Publication Data

US 2005/0210926 A1 Sep. 29, 2005

(30) Foreign Application Priority Data

Mar. 25, 2004 (KR) ..... 10-2004-0020450

(51) Int. Cl.
*D06F 39/00* (2006.01)

(52) U.S. Cl. ..... 68/3 R; 68/12.27; 362/85

(58) Field of Classification Search ..... None
See application file for complete search history.

(56) References Cited

U.S. PATENT DOCUMENTS 3,686,814 A * 8/1972 Anderson ..... 52/456
4,890,435 A * 1/1990 Wilkening et al. ..... 52/456
5,574,623 A * 11/1996 Girard ..... 361/627
5,694,793 A * 12/1997 Nishimura et al. ..... 68/12.27
6,177,156 B1 * 1/2001 Glover et al. ..... 428/34
6,425,221 B1 * 7/2002 Reichert ..... 52/456
6,502,431 B1 * 1/2003 Yamano et al. ..... 68/3 R
2002/0003592 A1 * 1/2002 Hett at al. ..... 349/58
2003/0028258 A1 * 2/2003 Peterson ..... 700/11
2005/0178167 A1 * 8/2005 Kim et al. ..... 68/12.27

FOREIGN PATENT DOCUMENTS

WO WO03056092 * 7/2003

* cited by examiner

*Primary Examiner*—Michael Barr
*Assistant Examiner*—Eric Golightly
(74) *Attorney, Agent, or Firm*—Birch, Stewart, Kolasch & Birch, LLP

(57) ABSTRACT

A control panel assembly for a washing machine is provided. The control panel assembly is installed at a case of the washing machine so that a user can handle the washing machine. The control panel assembly includes a circuit board, a cover and a member. The circuit board includes a given area having one or more displays densely attached thereon. The cover is attached on a case of the washing machine so as to cover the circuit board, and includes one window for showing all of the displays. The member is configured to be detachable from the window to thereby divide the window into several areas. The control panel assembly may further include a member attached on the window to thereby divide the window into several areas or cover boundaries between the displays.

6 Claims, 3 Drawing Sheets

CONTROL PANEL ASSEMBLY FOR WASHING MACHINE

This application claims the benefit of the Korean Application No. P2004-20450 filed on Mar. 25, 2004, which is hereby incorporated by reference.

BACKGROUND OF THE INVENTION

1. Field of the Invention

The present invention relates to a washing machine, and more particularly, to a control panel assembly for a washing machine, which is installed at a case of the washing machine so that a user can handle the washing machine by using the same.

2. Discussion of the Related Art

A washing machine is a typical home appliance which washes the laundry by using a detergent and water. The washing machine is classified into a top loading-type washing machine and a front loading-type washing machine according to loading positions of the laundry. In general, the top loading-type washing machine is constructed to include a vertical tub for receiving the laundry, a pulsater for washing the laundry during its rotation in the tub, and a lid provided at an upper surface of the washing machine so as to cover/uncover the tub. In the meantime, the front loading-type washing machine is constructed to include a horizontal drum for receiving the laundry, a plurality of lifters provided at an inner surface of the drum so as to repeatedly lift and then drop the laundry during the rotation of the drum, and a door provided at a front surface of the washing machine so as to cover/uncover the drum.

In the meantime, producers provide various collections of washing machines in consideration of a washing capacity and a selling price even though the washing machines belong to the same kind and have the same size case. For example, a touch-screen LCD is adopted as a display attached at a control panel in high-priced washing machines, but a simple multi-segmented LED display is adopted as the display in high-priced washing machines. In this case, since different types of displays may be attached to a control panel, the control panel should be designed differently according to the different types. Therefore, when producers desire to provide various collections of washing machines, the design and production cost of the washing machine is accordingly increased.

SUMMARY OF THE INVENTION

Accordingly, the present invention is directed to a control panel assembly for a washing machine that substantially obviates one or more problems due to limitations and disadvantages of the related art.

An object of the present invention is to provide a compatible control panel assembly capable of adopting various kinds and types of displays.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a control panel assembly for a washing machine includes: a circuit board including a given area having one or more displays densely attached thereon; and a cover attached on a case of the washing machine so as to cover the circuit board and including one window for showing all of the displays.

The control panel assembly may further include a member attached on the window to thereby divide the window into several areas or cover boundaries between the displays. The member may include a transparent film attached on the window, and the transparent film may have a mark printed thereon so as to divide the window into several areas or cover boundaries between the displays. The member may include a lattice attached on the window to thereby divide the window into several areas or cover boundaries between the displays. The member comprises a lattice attached on the window to thereby divide the window into several areas.

The display may include a plurality of multi-segment LED displays.

In another aspect of the present invention, a washing machine includes: a case; a rotatably drum provided in the case; a door provide at the case, for covering/uncovering the drum; and a control panel assembly including: a circuit board including a given area having a plurality of displays densely attached thereon; a cover attached on a case of the washing machine so as to cover the circuit board and including one window for showing all of the displays; and a member detachably attached on the window to thereby divide the window into several areas.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
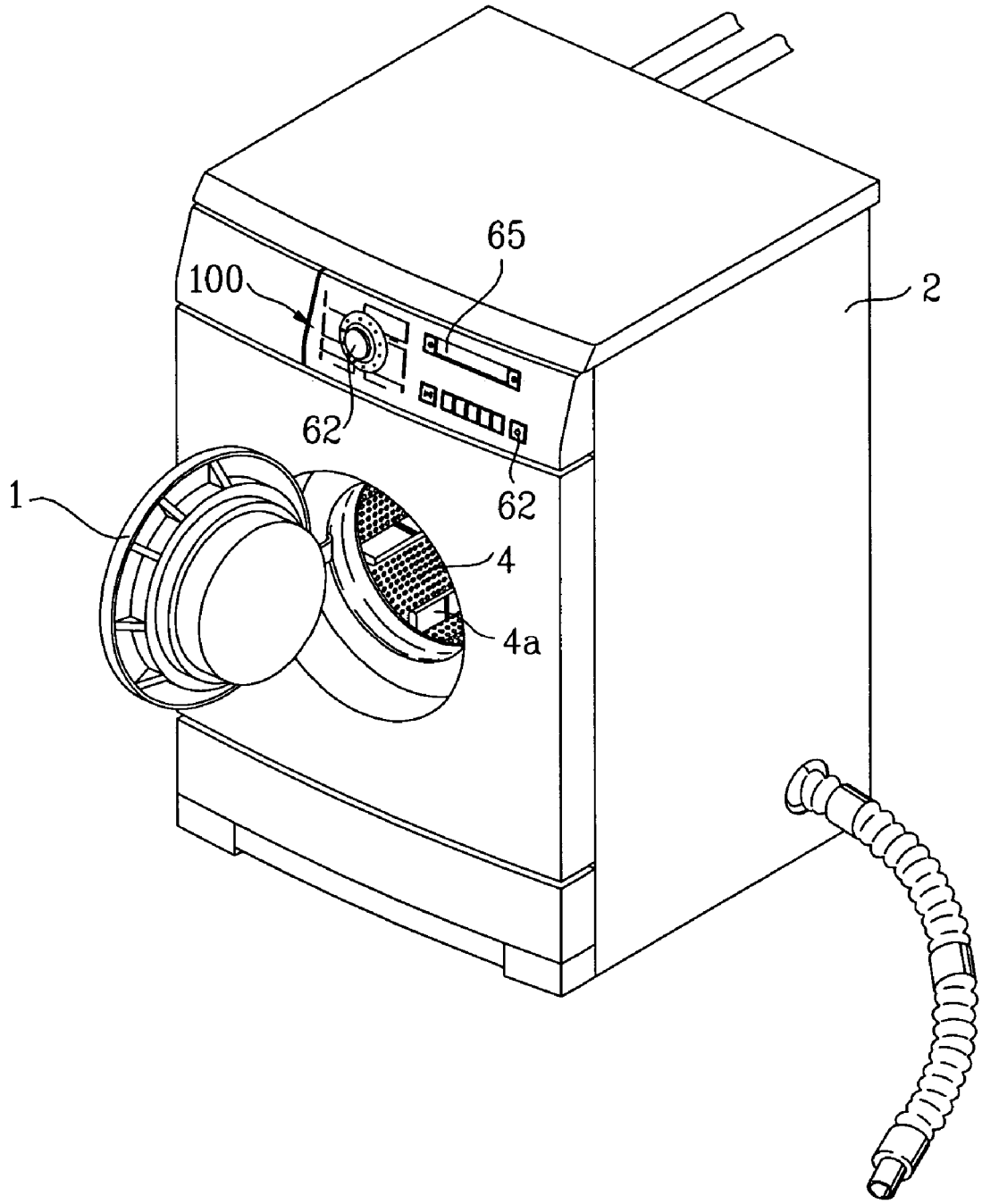
FIG. 1 is a perspective view of a washing machine according to the present invention.

FIG. 1 is a perspective view of a washing machine according to the present invention.

Referring to FIG. 1, a rotatable horizontal drum 4 is installed in a case 2 of a washing machine. In detail, the drum 4 is installed in a tub (not shown) provided in the case 2. Washing water is stored in the tub, and a plurality of apertures through which the washing water can be passed is provided on a circumference surface of the drum 4. A plurality of lifters 4A are installed in the drum 4. The lifters 4A repeatedly lift and then drop the laundry in the drum 4 during the rotation of the drum 4. A door 1 is installed in a front side of the case 2, for covering/uncovering the drum 4.

A control panel assembly 100 enabling a user to handle the washing machine is provided at one side (for example, an upper front side) of the case 2. The control panel assembly 100 includes a plurality of buttons capable of being pressed by a user, and a display window for showing an operation status of the washing machine to a user.

Figure 2:
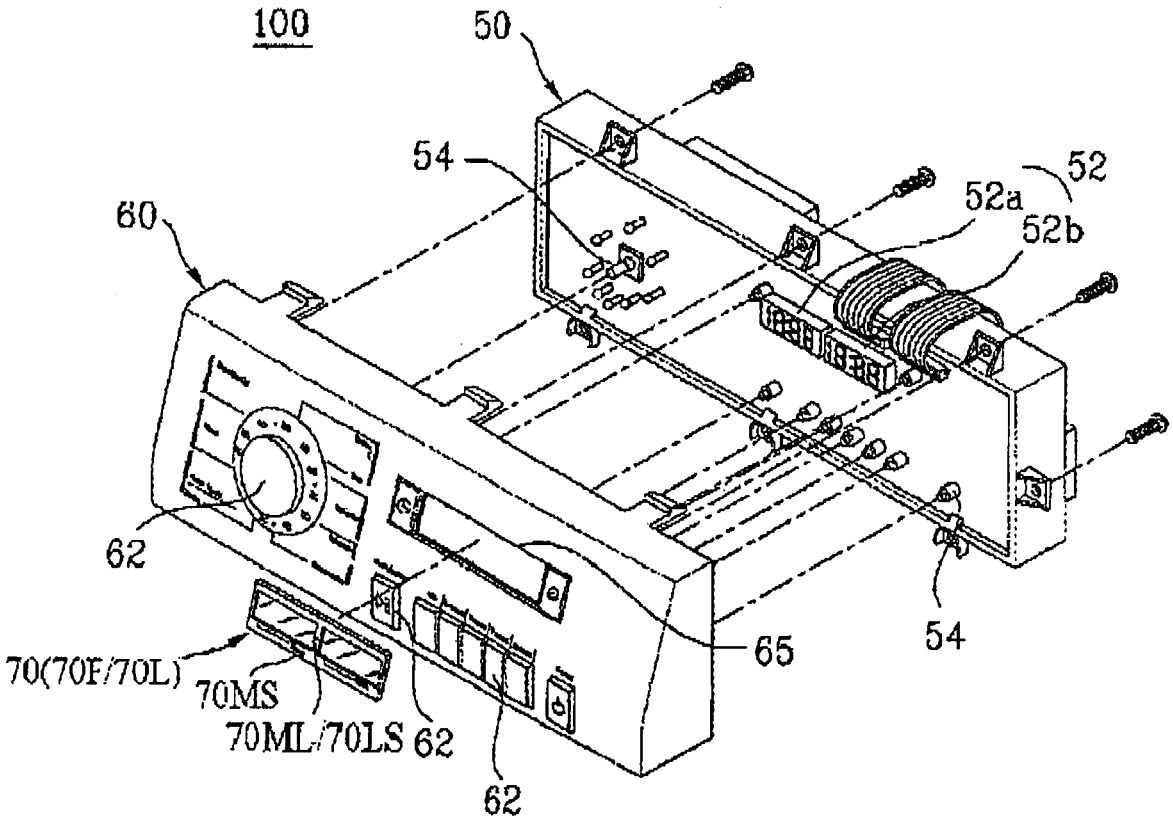
FIG. 2 is an exploded perspective view of a control panel assembly according to an embodiment of the present invention.

FIG. 2 is an exploded perspective view of a control panel assembly 100 according to an embodiment of the present invention.

Referring to FIG. 2, the control panel assembly 100 includes a circuit board 50 and a cover 60. The circuit board 50 is equipped with electronic outfits including various switches 54 and displays 52. The cover 60 is attached at the case 2 to thereby cover the circuit board 50.

Here, the cover 60 includes buttons 62 corresponding to the switches 54, and a window 65 for showing all of the displays 52 to a user. A user can handle the washing machine by pressing the buttons 62, and the window 65 enables the user to view washing information displayed on the displays 52.

In detail, one or more displays 52 (for example, a plurality of displays 52) are densely attached on a given area of the circuit board 50. The displays 52 displays various information about an washing operation, such as the remaining wash time period, the rotation speed of the drum 4, a current washing process, a selected washing course, a water temperature, and the like.

For example, the displays 52 include a plurality of multi-segment LED (light emitting diode) displays densely attached on the given area as shown in FIG. 2. In detail, the displays 52 include a first 4-segment display unit 52A for displaying the remaining wash time in hour and minute by Arabic numerals, and a second 4-segment display unit 52B for displaying the rotation speed of the drum 4 by rpm. Here, the first display unit 52A and the second display unit 52B are horizontally or vertically aligned.

In the meantime, the window 65 is formed large enough to be able to show all of the displays 52 to a user. The window 65 may be formed of a transparent material or a simple opening. Since the window 65 shows all of the several displays 52, boundaries between the displays 52 are also viewed by a user. This may cause the deterioration of the washing machine's beauty.

Accordingly, the control panel assembly 100 further includes a member 70 (that is, the film 70F or the lattice 70L) for covering the boundaries between the displays 52. The member 70 is attached on the window 65 to thereby divide the window 65 into several areas and cover the boundaries between the displays 52.

For example, two, three or four displays 52 may be provided in the given area. In this case, the boundaries of the displays 52 are varied according to a change in the number of the displays 52. Accordingly, so as to enhance the compatibility of the control panel assembly 100, the member 70 (that is, the film 70F or the lattice 70L) is configured to be detachable from the window 65. This detachability of the member makes it possible to minimize a cost required for design change.

In case where the window 65 includes a transparent glass or plastics, the member 70 (that is, the film 70F or the lattice 70L) is constructed to include a transparent film 70F attached on the window 65. Printed on the film 70F are a mark (for example, a line 70ML) for segmenting the displays 52 and a sign 70MS for indicating the meanings of the numerals displayed by the displays 52.

The member 70 (that is, the film 70F or the lattice 70L) may include a lattice 70L for dividing the window 65 into several areas. The lattice 70L includes at least one strip 70LS detachably attached on the window 65 to thereby segment the window 65 and cover the boundaries between the displays 52.

Figure 3:
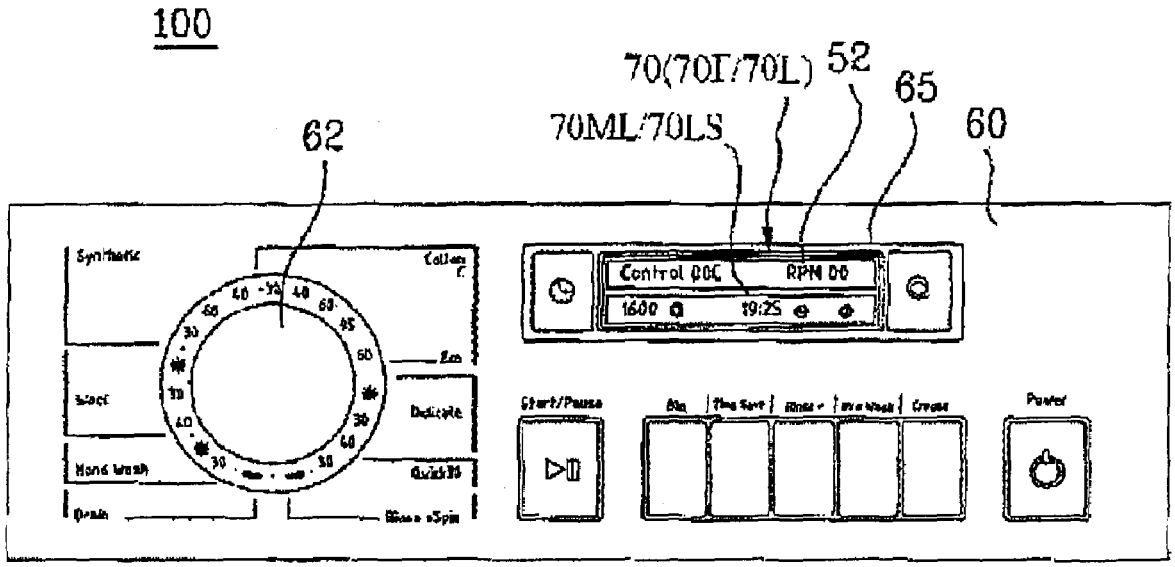
FIG. 3 is a plan view of a control panel assembly according to another embodiment of the present invention.

FIG. 3 is a plan view of a control panel assembly according to another embodiment of the present invention.

Referring to FIG. 3, the displays 52 may include a LCD (liquid crystal display). In this case, the displays 52 may include one LCD having the same size as the window 65, or may include a plurality of small LCD. In this case also, the member 70 (that is, the film 70F or the lattice 70L) may be provided on the window 65. FIG. 3 illustrates an example where a transparent film 70F having the line printed thereon is attached on a front surface of the LCD adopted as the displays 52.

As stated above, the control panel assembly according to the present invention is constructed in such a way that one window can show all the displays even though different kinds or different numbers of displays are attached on the circuit board. Also, the member 70 divides the window 65 into several areas and simultaneously covers the boundaries between the displays 52. Therefore, although the kind or the number of the displays is changed, the changed displays can be compatibly used by means of the member 70 without changing the cover. Accordingly, a cost required for design change can be minimized.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A control panel assembly for a washing machine, comprising:

a circuit board including a given area having a plurality of displays closely adjacent to one another thereon;

a cover attached on a case of the washing machine so as to cover the circuit board and including one window for showing all of the displays; and a member attached on the window to thereby divide the window into separate areas, wherein the member comprises a transparent film attached on the window, and the transparent film has a mark printed thereon so as to divide the window into separate areas.

2. The control panel assembly of claim 1, wherein the member is configured to be detachable from the window.

3. The control panel assembly of claim 1, wherein the mark printed on the transparent film covers boundaries between the displays.

4. A control panel assembly for a washing machine, comprising:

a circuit board including a given area having a plurality of displays closely adjacent to one another thereon;

a cover attached on a case of the washing machine so as to cover the circuit board and including one window for showing all of the displays; and a transparent member detachably attached on the window and having a printed line thereon for covering boundaries between the closely adjacent displays.

5. A washing machine comprising:

a case;

a drum rotatably provided in the case;

a door provided at the case, for covering/uncovering the drum; and a control panel assembly comprising:

a circuit board including a given area having a plurality of displays closely adjacent to one another thereon;

a cover attached on a case of the washing machine so as to cover the circuit board and including one window for showing all of the displays; and a member detachably attached on the window to thereby divide the window into several areas, wherein the member comprises a transparent film attached on the window and the transparent film has a mark printed thereon so as to cover boundaries between the displays.

6. A control panel assembly for a washing machine, comprising:

a circuit board including a given area having a plurality of displays thereon;

a cover attached on a case of the washing machine so as to cover the circuit board and including one window for showing all of the displays; and a member attached on the window and comprising a transparent film, wherein the transparent film has a mark printed thereon so as to cover boundaries of the displays.

* * * * *